United States Patent [19]

Provost

[11] Patent Number: 4,824,261

[45] Date of Patent: Apr. 25, 1989

[54] RECLOSABLE BAG AND HOOK AND LOOP SEALING STRIPS FOR USE THEREIN

[75] Inventor: George A. Provost, Litchfield, N.H.

[73] Assignee: Velcro Industries B.V., Amsterdam, Netherlands

[21] Appl. No.: 180,622

[22] Filed: Apr. 1, 1988

Related U.S. Application Data

[63] Continuation of Ser. No. 924,205, Oct. 22, 1986, abandoned, which is a continuation-in-part of Ser. No. 790,966, Oct. 24, 1985, abandoned.

[51] Int. Cl.[4] ..... B65D 33/24; A44B 18/00

[52] U.S. Cl. ..... 383/81; 24/306; 24/444; 206/610; 206/618; 383/79; 383/86; 383/99

[58] Field of Search ..... 206/610, 616–618; 24/306, 442–450; 383/78, 79, 84, 86, 98, 99, 80, 81

[56] References Cited

U.S. PATENT DOCUMENTS

| | | | |
|---|---|---|---|
| 1,920,321 | 8/1933 | Rosmait | 383/79 |
| 2,934,255 | 4/1960 | McDuffie | 383/79 X |
| 3,123,479 | 3/1964 | Drutt | 206/618 X |
| 3,154,239 | 10/1964 | Madsen | 383/81 |
| 3,203,621 | 8/1965 | Wright | 383/81 |
| 3,321,126 | 5/1967 | Rivman et al. | 383/84 X |
| 3,557,853 | 1/1971 | Jones | 383/86 |
| 3,807,626 | 4/1974 | Goodrich | 206/618 X |
| 4,617,214 | 10/1986 | Billarant | 24/306 X |

OTHER PUBLICATIONS

Drawings by Examiner (1+2).

*Primary Examiner*—Stephen Marcus
*Assistant Examiner*—Bryon Gehman
*Attorney, Agent, or Firm*—Hayes, Soloway, Hennessey & Hage

[57] ABSTRACT

A tamperproof, resealable bag of the type used to sell and store materials such as dog food, and the like. A unique sealing strip of the hook and loop fastening variety is employed therein. The bag is a flexible, frangible material such as paper and includes a flap extending from the rear edge over the front edge and down along the front piece. A strip of adhesive is disposed along the bottom edge of the flap to secure it to the front piece. A piece of cording is disposed between the flap and the front piece adjacent the top of the adhesive strip with an end extending outward therefrom for gripping. The two strips comprising the hook and loop fastening system are disposed between the flap and the front piece above and adjacent to the cording with one of the strips adhesively attached to the flap and the other to the front piece of the bag. When the cording is pulled across the flap, the flap is fractured and separated along the line close adjacent the lower edge of the strip so that thereafter the outer one of the strips can be gripped to pull the pair of strips out of attachment to one another without pulling the flap apart from its adhesive attachment to its strip. In the preferred embodiment, the strips include an area adjacent the bottom edge where the hooks are not included such that the strips can be rolled apart for gripping.

11 Claims, 5 Drawing Sheets

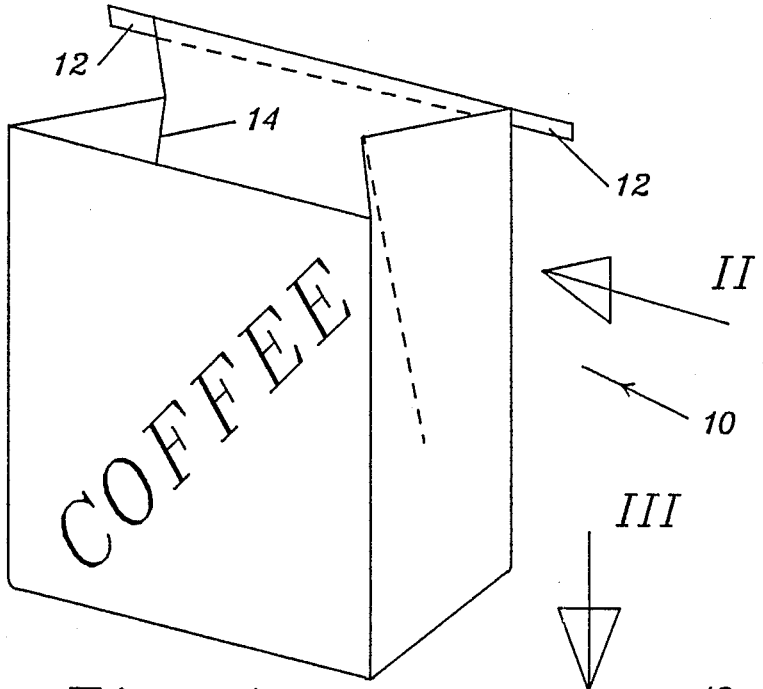
Fig. 1
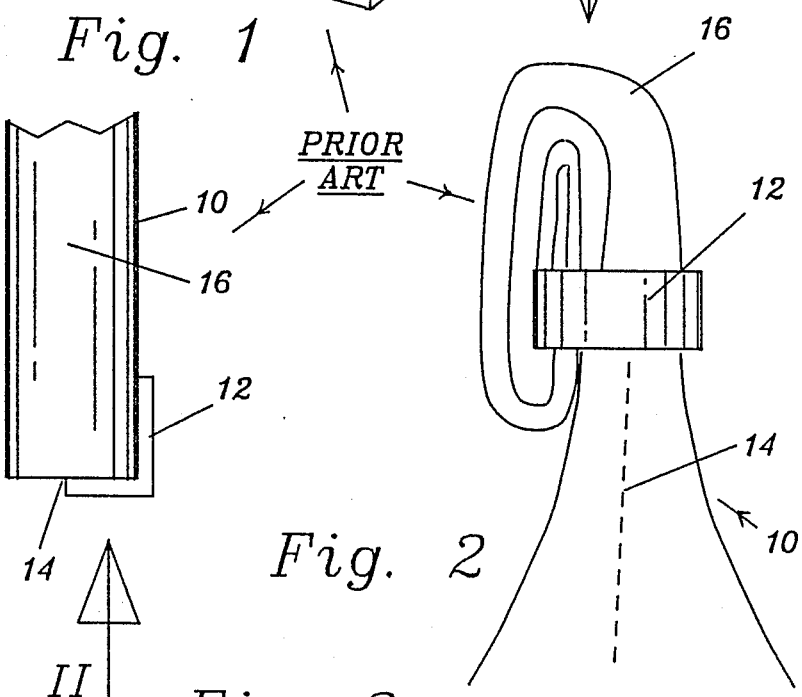
Fig. 2
Fig. 3

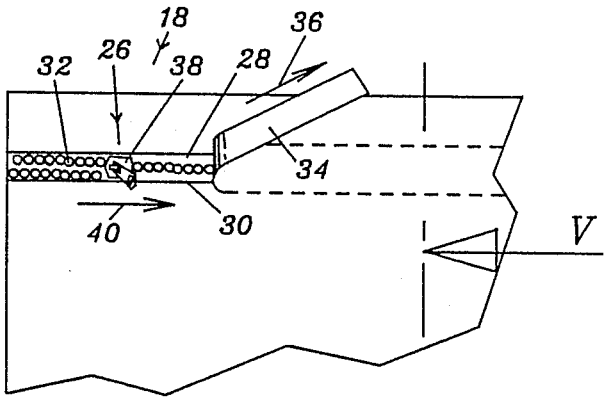
Fig. 4
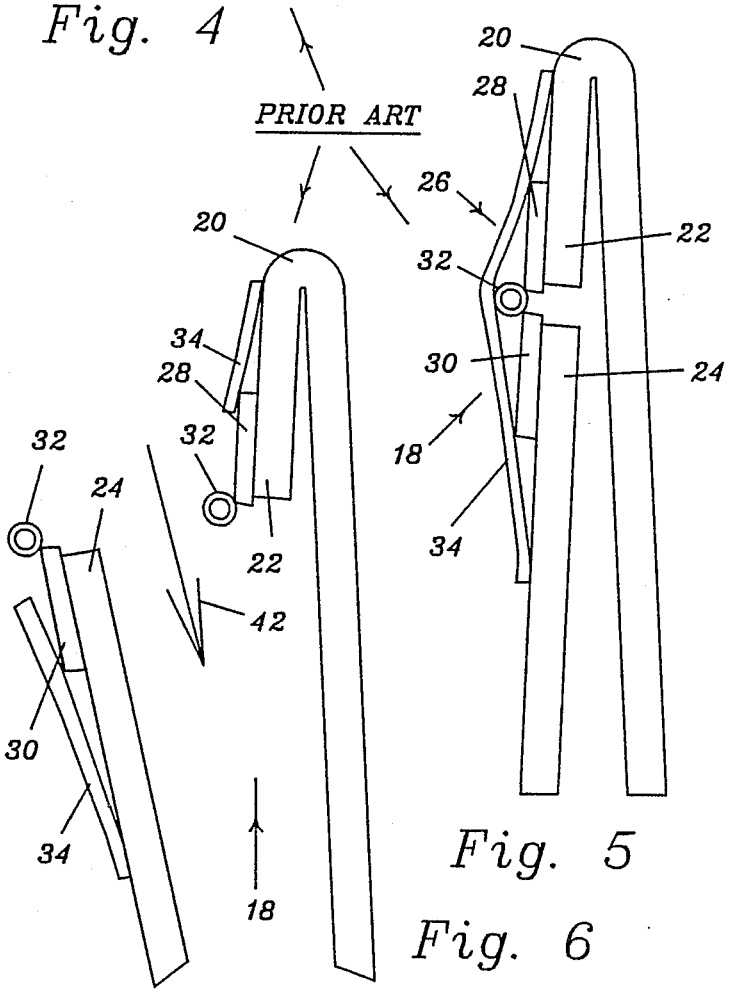
Fig. 5
Fig. 6

RECLOSABLE BAG AND HOOK AND LOOP SEALING STRIPS FOR USE THEREIN

This is a continuation of a co-pending application Ser. No. 924,205 filed on Oct. 27, 1986 now abandoned which is a continuation in part of application Ser. No. 790,966, filed Oct. 24, 1985 now abandoned.

BACKGROUND OF THE INVENTION

The present invention relates to resealable bags, and, more particularly, to a bag of a flexible, frangible material, including a bottom, opposed spaced sides, and opposed spaced front and rear pieces terminating at the top and front and rear edges respectively, wherein tamperproof resealability is provided by a flap of the flexible, frangible material extending from the rear edge over the front edge and down along the front piece; a strip of adhesive disposed along the bottom edge of the flap to secure it to the front pieces; a piece of cording disposed between the flap and the front piece adjacent the top of the adhesive strip with at least one end extending from between the flap and the front piece sufficiently for gripping; and, a pair of strips of a hook and loop fastening system disposed between the flap and the front piece above and adjacent to the cording with one of the pair of strips adhesively attached to the flap and the other of the pair of strips adhesively attached to the front piece whereby when the cording is pulled across the flap, the flap between the pair of strips and the strip of adhesive is fractured and separated along a line close adjacent the lower edge of the strip so that thereafter the one of the pair of strips can be gripped to pull the one of the pair of strips out of attachment to the other of the pair of strips without pulling the flap apart from its adhesive attachment to the one of the pair of strips.

Resealable bags have been known in the art for years. For example, before it became popular to sell previously ground coffee in vacuum packed cans, coffee was sold as whole roasted beans in a bag such as that generally indicated as 10 in FIG. 1. The coffee bag 10 has metal tabs 12 extending outward from one side of the top. The two sides of the top were pinched together by folding the sides as at 14. the top of the bag was then rolled down so as to appear as in FIG. 2 when viewed in the direction of arrow II in FIG. 1. The metal tabs 12 were then bent around the folded-down top 16 as shown in FIGS. 2 and 3. When the coffee was purchased, the metal tabs 12 were unfolded, the folded top 16 unrolled, and the beans (not shown) poured out of the bag 10 into a grinder from whence they were directed from a shoot back into the bag 10 which was then resealed in the manner described above.

More recently, the sale of "economy size" bags of pet food, and the like, has increased in popularity. Large bags of such materials open at the top are easily spilled and, therefore, there has been a corresponding desirabilty of providing a tamperproof resealable form for such bags. That is, such bags are normally sealed shut until time of use. At that time, a tear strip is removed allowing the bag to be opened. Thus, the object is to provide resealability for such sealed or tamper-proof bags.

A recent attempt at a solution to the problem is shown in FIGS. 4–6. A shown therein the bag 18 is folded over at 20 to provide abutting edges, 22, 24 adjacent the top of the bag. A zipper, generally indicated as 26, of the type having two sides 28, 30 carrying intermeshing plastic loop teeth 32 is attached to the abutting edges 22, 24 and covered with a sealing strip 34. At time of initial use, the sealing strip 34 is peeled off of the zipper 26 as indicated by the arrow 36. The zipper 26 can then be opened by pulling the tab 38 and the direction of arrow 40 in the usual manner of operation for zippers. To close the bag, the tab 38 is pulled in the direction opposite arrow 40, also in the conventional manner. With the zipper 26 in its open position, the abutting edges 22,24 can be pulled apart to provide an entrance into the bag 18 as symbolized by the arrow 42 in FIG. 6.

The use of a zipper in such applications has numerous drawbacks. The zipper 26, as is typical, is an entity comprising its two sides 28,30 and the tab 38 which must be mounted on the teeth 32 with the teeth 32 in proper meshed relationship. This, of course, adds greatly to the complexity and cost of construction of the bag 18. Moreover, as it also well known by anyone who has used zippers, any foreign material becoming lodged in the teeth 32 will prevent proper operation of the zipper 26. The tab 38 may become completely immovable. Additionally, if the zipper 26 is assumed closed, one may find that a piece of the material contained in the bag 18 has become lodged in the teeth 32 preventing proper intermeshing. Shortly thereafter, the teeth 32 will come out of engagement and the zipper 26 completely open allowing the contents of the bag 18 to spill.

Wherefore, it is the object of the present invention to provide a reclosable bag of the type described with respect to FIGS. 4–6 but eliminating the problems attendant thereto.

SUMMARY

The foregoing objective has been realized in a bag of a flexible, frangible material including a bottom, opposed spaced sides, and opposed spaced front and rear pieces terminating at the top in front and rear edges respectively, by the improvement of the present invention comprising:

a flap of the flexible, frangible material extending from the rear edge over the front edge and down along the front piece;

a strip of adhesive disposed along the bottom edge of the flap to secure it to the front piece;

a piece of cording disposed between the flap and the front piece adjacent the top of the adhesive strip with at least one end extending from between the flap and the front piece sufficiently for gripping; and a pair of strips of a hook and loop fastening system disposed between the flap and the front piece above and adjacent the cording with one of the pair of strips adhesively attached to the flap and the other of the pair of strips adhesively attached to the front piece, the pair of strips including an area on their lower edge in which there is no ability for the pair of strips to form a releasable attachment to one another whereby when the cording is pulled across the flap, the flap between the pair of strips and the adhesive is fractured and separated along a line close adjacent the lower edge of the strips and thereafter the one of the pair of strips can be rolled back at the area away from the other of the pair of strips sufficiently to be gripped to pull the one of the pair of strips out of attachment to the other of the pair of strips without pulling the flap apart from its adhesive attachment to the one of the pair of strips.

The novel hook and loop fastening system employed in the bag of the present invention also has independent use where it is desired to employ a hook and loop strip fastening system adhesively fastened to respective sides of a closure and wherein delamination of the adhesive fastening during repeated opening and closing of the fastening system is desired to be avoided.

DESCRIPTION OF THE DRAWINGS

FIG. 1 is a perspective view of a reclosable bag such as used for coffee to permit opening and grinding at the point of sale.

FIG. 2 is a view of the bag of FIG. 1 as it would appear in the direction of arrow II when the top is rolled down and the tabs folded over in the locked position.

FIG. 3 is a top view of one end of FIG. 2.

FIG. 4 is a front view of a prior art approach to a resealable bag employing a zipper therein.

FIG. 5 is a cutaway view of the bag of FIG. 4 in the Plane V—V.

FIG. 6 shows the bag of FIG. 4 in the Plane V—V as it would appear with the zipper opened and the bag opened for use.

DESCRIPTION OF THE PREFERRED EMBODIMENT

Figure 7:
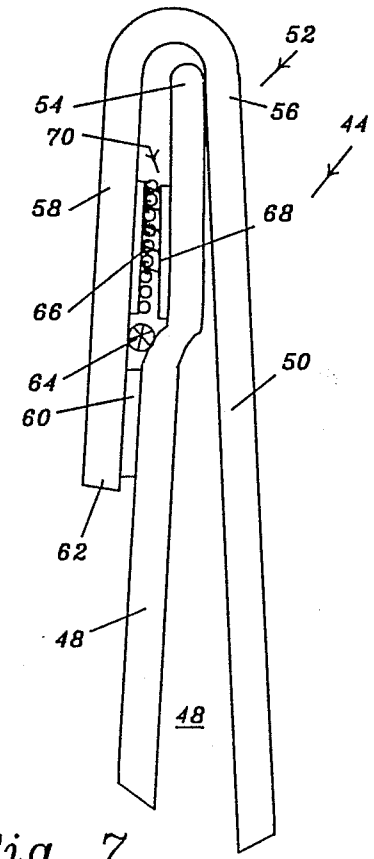
FIG. 7 is a cutaway side elevation through the top flap portion of a bag according to the present invention.

FIG. 7 shows the top of a bag 44 incorporating the present invention in its preferred embodiment. Bag 44, while possible to manufacture as a tubular construction with a sewn bottom, can generally be described as having a bottom (not shown), opposed spaced sides 46, and opposed spaced front and rear pieces 48,50, respectively, terminating a the tip 52 in front and rear edges 54 and 56, respectively. Bag 44 is of a flexible, frangible material, typically multi-layer coated paper.

According to the present invention, a flap 58 of the same flexible, frangible material extends from the rear edge 56 over the front edge 54 and down along the front piece 48. A strip of adhesive 60 is disposed along the bottom edge 62 of the flap 58 to secure it to the front piece 48. Various forms of adhesive can be used at 60, however, adhesive of the hot melt variety is preferred for ease of manufacture. A piece of cording 64 is disposed between the flap 58 and the front piece 48 adjacent the top of the adhesive strip 60 with at least one end thereof extending from between the flap 58 and the front piece 48 sufficiently for gripping. That will be recognized by those skilled in the art, cording, string, tape, or the like, as thus positioned can be used to fracture the flap 58 which in its originally secured position as just described acts as a tamperproof closing for the bag 44 prior to initial opening. As will also be recognized by those skilled in the art, other means for fracturing the flap 58 could be employed within the scope and spirit of the present invention such as providing a perforated tear strip within the flap 58 itself.

A pair of strips 66 and 68 of a hook and loop fastening system generally indicated as 70 are disposed between the flap 58 and the front piece 48 above and adjacent to the cording 64 with strip 66 adhesively attached to the flap 58 and strip 58 adhesively attached to the front piece 48. Again, for ease of manufacture, it is preferred that the strips 66,68 be adhesively attached to the flap 58 and front piece 48 by a hot melt adhesive for ease of manufacture (however, pressure sensitive adhesives, for example, could also be used). The hook and loop fastening system 70, comprising strips 66,68, is of a type generally well known to those skilled in the art and, in particular, sold by the assignee of this application under the trademark Velcro. The preferred embodiment of the present invention as being described incorporates a new and novel embodiment of the hook and loop fastening system 70 which will be described in greater detail shortly.

Figure 9:
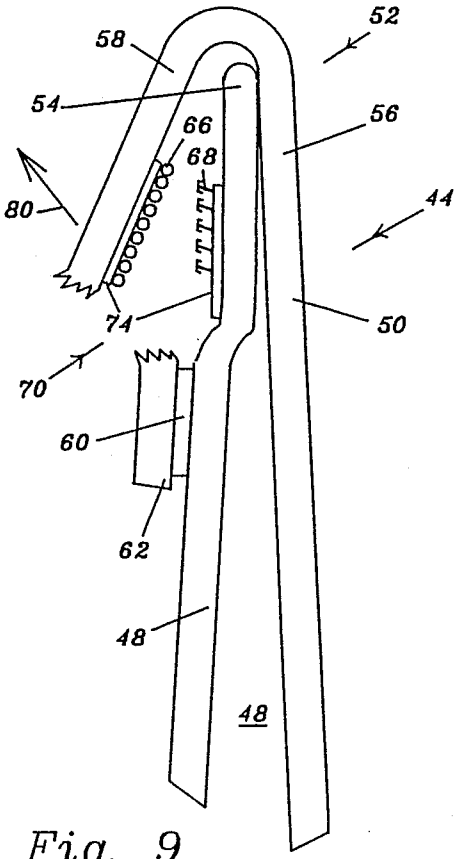
FIG. 9 shows the bag of FIG. 7 following the initial opening of FIG. 8 with the sealing strip released and the flap being raised for access to the bag.
Figure 8:
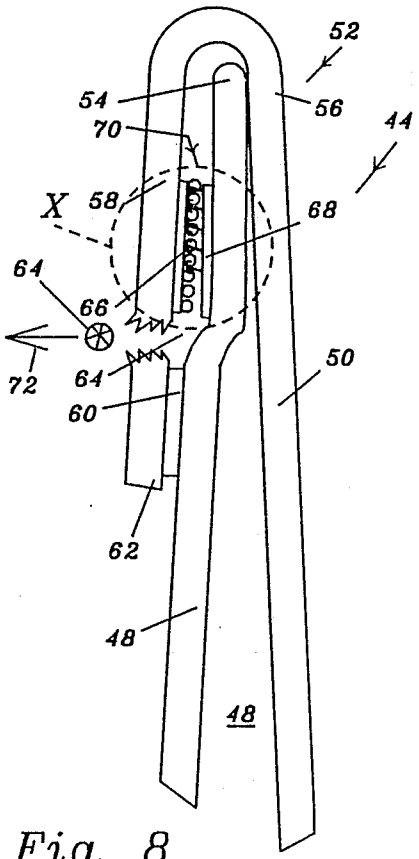
FIG. 8 shows the bag portion of FIG. 8 in the area of the resealable closing strips as the flap is being fractured by pulling of the cording.
Figure 11:
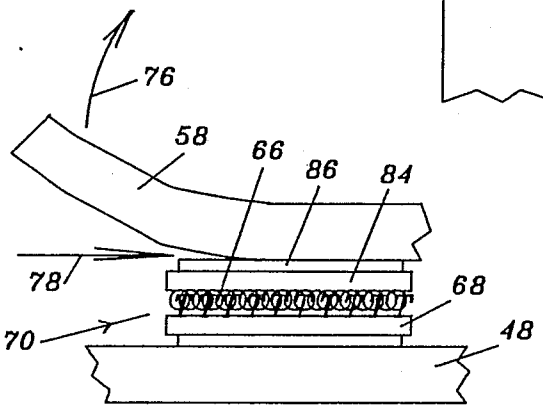
FIG. 11 is a drawing showing the delamination problem solved by the strip fastening system of the present invention.

As shown in FIG. 8, as the cording 64 is pulled outwardly in the direction of arrow 72, the flap 58 is fractured and separated close adjacent the bottom edge 74 of the strips 66,68. By so doing, the strip 66 adhesively attached to the flap 58 can be gripped to pull it from its engagement from strip 68 without a delaminating problem depicted in FIG. 11 which would otherwise take place. As seen in FIG. 11, if the flap 58 were allowed to extend beyond the strip 66 and the peeling or separating force were applied in the direction of arrow 76, there is a good chance that, at least after several openings and closing, the flap 58 would delaminate at the adhesive 60 from the strip 66 at the point indicated by arrow 78. Shortly, flap 58 would then completely separate from strip 66 and the reclosability feature would be lost. By being able to grip strip 66 directly and apply the initial peeling force thereto, the delaminating problem of FIG. 11 is substantially avoided. Once the strips 66,68 have been separated, the flap 58 can be lifted as indicted by the arrow 80 in FIG. 9 and front edge 54 pulled outward in the direction of arrow 82 to provide entrance to the bag 44. Closure and resealing is, of course, a reverse of the above-described procedure. The front and rear edges 54,56 are pressed together and the flap 58 pulled down over the front edge 54 until the strips 66,68 can be pressed together into releasable attachment with one another.

Figure 10:
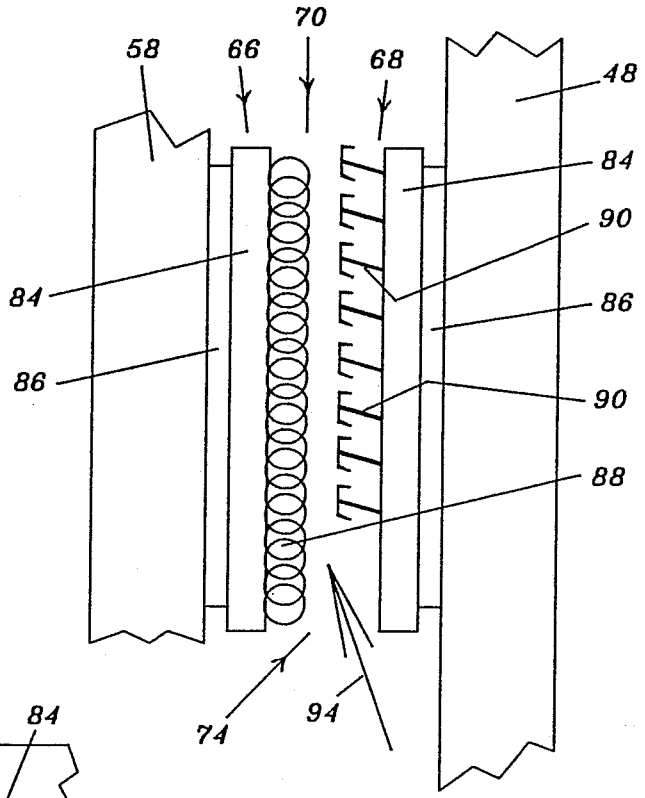
FIG. 10 is a detailed drawing in the area designated as X in FIG. 8 showing the details of the unique loop and hook fastening system of the present invention.

Turning now with particularlity to FIG. 10, the novel construction of the hook and loop fastening system 70 of the present invention will now be described in detail. As will be appreciated by those skilled in the art, the hook and loop fastening 70 provides benefits of delamination resistance for other uses besides bags as hereinbefore described when it is desired to apply the strip 66,68 with an adhesive such as hot melt, or otherwise, In the usual manner, one loop strip (in this case strip 66) comprises a backing material 84 such as polypropylene adapted to adhere to the adhesive 86 and covered with a loop material 88. The other strip (in this case strip 68) also has a backing 84 to which adhesive 86 will adhere with resiliently flexible "J" or "T" hooks 90 extending therefrom. To accomplish the purposes desired, an area at 94 is provided where the strips 66,68 will not adhere to one another. This is most easily accomplished by eliminating the hooks 90 in that area. In the preferred embodiment, the hooks 90 are disposed in longitudinal rows and to provide the area 92 at least one row, and preferably two or three, is eliminated. As a consequence, if outward pressure is exerted within the area 92 as symbolized by the arrow 94, strip 66 (in combination with the bottom of flap 58) can be rolled back sufficiently to allow the bottom edge of the strip 66 to the grip securely such that the strips 66,68 can be pulled out of the their entangled engagement with one another wherein the hooks 90 are entangled into the loop material 88.

Figure 12:
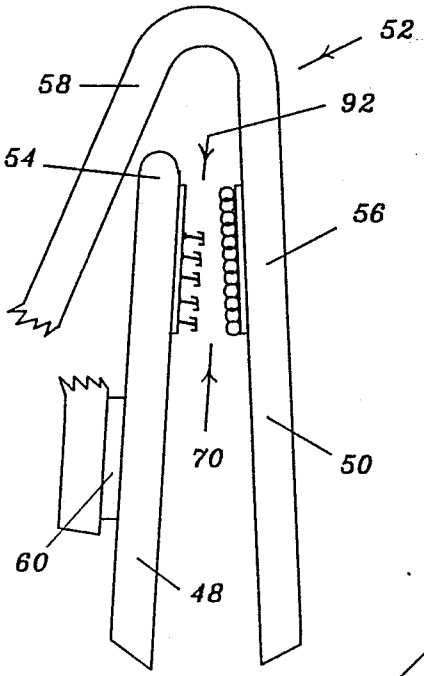
FIG. 12 is a drawing similar to that of FIG. 7 showing an alternate embodiment of the present invention.

The unique hook and loop fastening system 70 as thus described can also be incorporated into an alternate embodiment of the bag of the present invention as shown in FIG. 12. In this embodiment, the bag 96 is of substantially the same construction as bag 44 of the preferred embodiment. The hook and loop fastening system 70, however, is moved to a point wherein one strip is attached to the front edge 54 and the other to the rear edge 56 with the above described area 92 off the top 52. The flap 58 was attached with the adhesive 60 as previously described and with separation means such as the cording 64 adjacent thereto. Once opened, the flap is not resealable in this embodiment but the top 52 was resealable at the front and rear edges 54,56 by means of the fastening system 70 disposed therein. Because of the unique construction of the fastening system 70 as described above and the area 92 for gripping provided thereby, the strip 66 and front edge 54 can be securely gripped to pull them out of engagement with the strip 68 without causing the delamination problem of the adhesive previously described.

Figure 13:
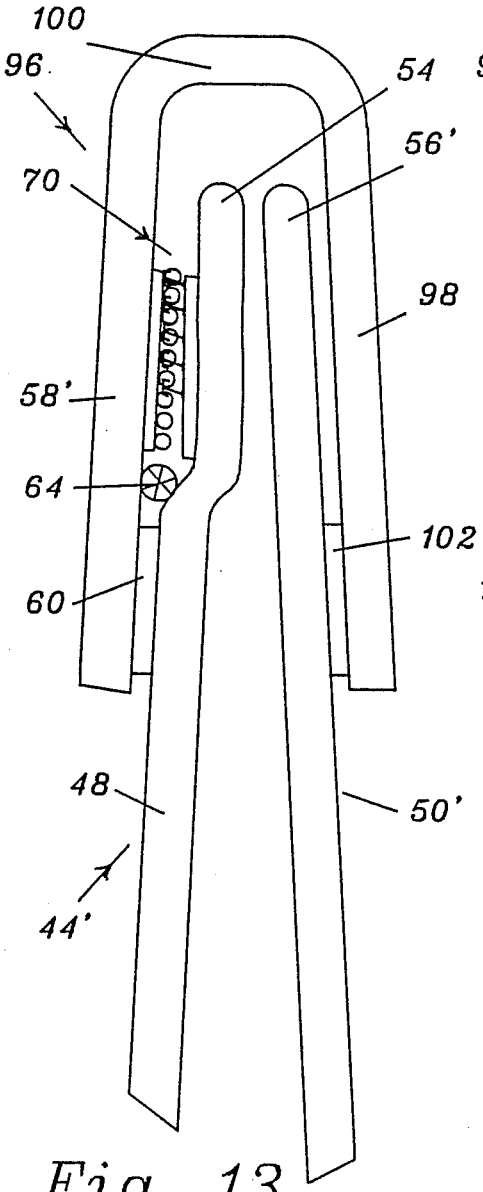
FIG. 13 is a drawing similar to that of FIG. 7 showing a second alternate embodiment of the present invention.
Figure 14:
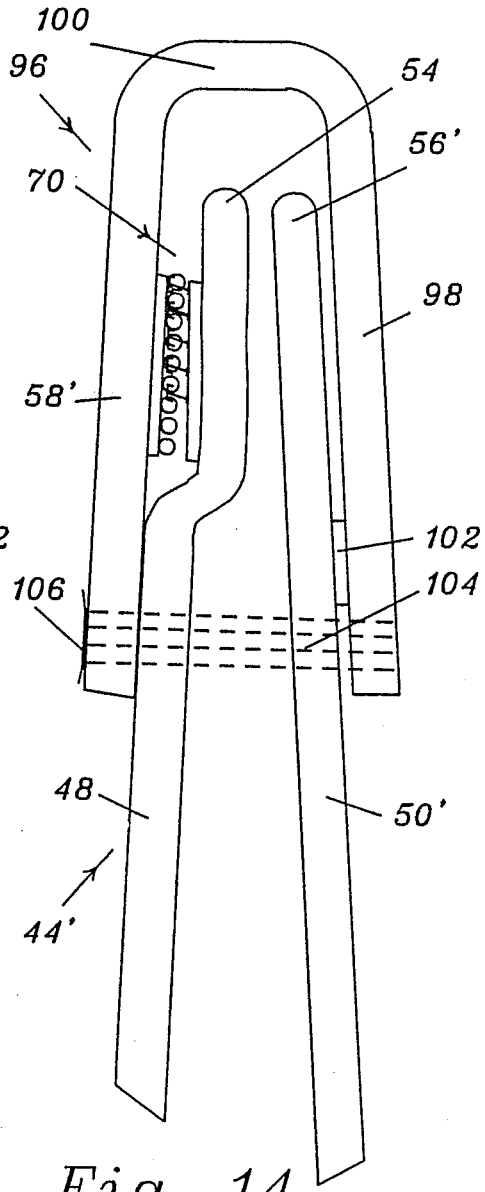
FIG. 14 is a drawing similar to that of FIG. 7 showing a third alternate embodiment of the present invention.

The present invention as hereinbefore described is also suitable for incorporation into the novel structure shown in the two additional embodiments of FIG. 13 and 14 wherein the flap 58 is part of a flap-containing member fastened to the top of an open-topped bag.

Turning first to the embodiment of FIG. 13, there is shown therein a bag 44' having a front piece 48 and a rear piece 50'. The front piece 48 terminates in a front edge 54 in the manner of the bags 44 previously described. The rear piece, however, terminates in a rear edge 56' which is parallel to the front edge 54 since it is an open-topped (i.e. un-flapped) bag. A flap-containing member 96 is folded over the edges 54,56' as shown in side view in FIG. 13 and comprises a front flap 58' and a rear flap 98 connected at fold point 100. The rear flap 98 is attached to the rear piece 50' with hot melt adhesive strip 102. The hook and loop fastening system 70 of the present invention is disposed between the front flap 58' and the front piece 50 along with hot melt adhesive strip 60 and cording 64 (for opening the bag) in identical manner to the embodiment previously described with respect to FIGS. 7–9 and the opening and resealing of this embodiment is performed in identical manner to that embodiment. The fold point 100 affords placement of the strips of the hook and loop fastening system 70 in substantial alignment with one another along their longitudinal edges so that one strip overlies the over strip.

The embodiment of FIG. 14 is similar to the embodiment of FIG. 13. Once again, there is a bag 44' having a front piece 48 and a rear piece 50'. The front piece 48 terminates in a front edge 54 and the rear piece terminates in a rear edge 56' which is parallel to the front edge 54. The flap-containing member 96 is once again folded over the edges 54,56' and comprises the same front flap 58' and rear flap 98 connected at fold point 100. In this embodiment, however, only the rear flap 98 is attached to the rear piece 50' with hot melt adhesive strip 102. The hook and loop fastening system 70 of the present invention is disposed between the front flap 58' and the front piece 50 in identical manner to the embodiment previously described with respect to FIG. 7–9 and that of FIG. 13. The adhesive strip 60 and cording 64 are eliminated, however, and replaced by chain-lock stitching 104 and pulls trip 106, which are well known in the bag art. The stitching 104 is stitched through and holds the bottom edges of the flaps 58',98 together. As is known, when the pulls trip 106 is pulled, the chain-lock stitching 104 unravels and pulls out as a single length of string, thus opening the bag 44' and allowing the flap 58' to be raised. Thereafter, the opening and resealing of this embodiment is performed in identical manner to the embodiment previously described with respect to FIGS. 7–9.

Wherefore, having thus described my invention, it can be seen that the present invention not only provides a reclosable bag with improved sealing means as desired. But, additionally, an improved hook and loop fastening system for use in adhesively applied applications where delamination of the glue adhesion is avoided despite repeated openings and closings.

Wherefore, having thus described my invention, I claim:

1. In a bag of flexible, frangible material including a bottom, opposed spaced sides, and opposed spaced front and rear pieces terminating at the top in front and rear edges respectively, the improvement to provide tamperproof resealability comprising:

(a) a flap-containing member of the flexible, frangible material having a front flap extending from a fold point over the front edge and down along the front piece and having a rear flap extending from said fold point over the rear edge and down along the rear piece;

(b) a strip of adhesive disposed along the bottom edge of said rear flap to secure it to the rear piece;

(c) attachment means disposed along the bottom edge of said front flap for securing it to the front piece;

(d) a pair of elongated strips of a hook and loop fastening system disposed between said front flap and front piece above and adjacent to said attachment means with one of said pair of strips adhesively attached to said front flap and the other of said pair of strips adhesively attached to the front piece, at least one of said pair of strips having an engaging area along an upper longitudinal edge portion which is sufficiently narrower than the engaging area of the other strip that the remaining area along a lower longitudinal edge of the one strip is lacking in the ability for that strip to form a releasable attachment to the adjacent area of the other strip, wherein said fold point of said flap-containing member provides a means of placing said strips in substantial alignment with one another along their longitudinal edges so that one strip overlies the other strip; and (e) releasing means, for releasing said front flap from said front piece, close adjacent said lower longitudinal edges of said pair of strips whereby after initial opening of the bag by releasing said releasing means and when one strip engages and overlies the other strip with their longitudinal edges substantially aligned with one another, said front flap and a sufficient portion adjacent the lower longitudinal edge of one of said pair of strips can be laterally rolled back away from the other of said pair of strips sufficiently to be directly gripped by human fingers to laterally pull the one strip out of attachment with the other strip, whereby the initial lateral separation forces of both strips are intermediate the longitudinal edges of said strips substantially along the boundary of said engaging area and said remaining area so that peeling of either of said pair of strips from said front flap and front piece is prevented thereby avoiding delamination of either strip from the member of the bag to which it is adhesively attached.

2. The resealability improvement to a bag of claim 1 wherein:

(a) said attachment means comprises a strip of adhesive disposed along the bottom edge of said front flap to secure it to the front piece; and said releasing means comprises, (b) fracturing means disposed for fracturing and splitting said front flap adjacent the bottom edge of said pair of strips.

3. The resealability improvement to a bag of claim 2 wherein said fracturing means comprises:

a piece of cording disposed between said front flap and the front piece adjacent the top of said adhesive strip with the cord extending at least from between said front flap and the front piece sufficiently for gripping

4. The resealability improvement to a bag of claim 1 wherein:

(a) said attachment means comprises a strip of chain-lock stitching disposed along the bottom edge of said front flap stitched through said front and rear flaps to secure said front flap to the front piece; and said releasing means comprises, (b) a pull strip operably attached under said chain-lock stitching for unlocking and pulling said stitching out of said flaps.

5. The improvement to a hook and loop fastening system of claim 1 wherein:

(a) the one strip with said sufficiently narrow engaging area is covered with resiliently flexible hooks;

(b) the other strip is covered with loop material for releasably engaging said hooks;

(c) said remaining area comprises a sufficient portion adjacent the lower longitudinal edge of the one strip where said hooks are missing; and (d) the adjacent area of the other strip is the portion of the strip laterally rolled back to be directly gripped by human fingers.

6. The improvement to a hook and loop fastening system of claim 1 wherein:

(a) the one strip with said sufficiently narrow engaging area is covered with resiliently flexible hooks;

(b) the other strip is covered with loop material for releasably engaging said hooks;

(c) said remaining area comprises a sufficient portion adjacent the lower longitudinal edge of the one strip where said hooks are missing; and (d) the remaining area of the one strip is the portion of the strip laterally rolled back to be directly gripped by human fingers.

7. A tamperproof resealable closure for a bag of flexible, frangible material including a bottom, opposed spaced sides, and opposed spaced front and rear pieces terminating at the top in front and rear edges respectively, said closure comprising:

(a) a flap-containing member of the flexible, frangible material having a front flap extending from a fold point over the front edge and down along the front piece and having a rear flap extending from said fold point over the rear edge and down along the rear piece;

(b) a strip of adhesive disposed along the bottom edge of said rear flap to secure it to the rear piece;

(c) attachment means disposed along the bottom edge of said front flap for securing it to the front piece;

(d) a pair of elongated strips of a touch fastening system positioned to be disposed between said front flap and front piece above and adjacent to said attachment means where one of said pair of strips is adhesively attached to said front flap and the other of said pair of strips is adhesively attached to said front piece, at least one of said pair of strips having an engaging area along an upper longitudinal edge portion which is sufficiently narrower than the engaging area of the other strip that the remaining area along a lower longitudinal edge of the one strip is lacking in the ability for that strip to form a releasable attachment to the adjacent area of the other strip, wherein said fold point of said flap-containing member provides a means of placing said strips in substantial alignment with one another along their longitudinal edges so that one strip overlies the other strip; and (e) releasing means, for releasing said front flap from said front piece, close adjacent said lower longitudinal edges of said pair of strips, whereby after initial opening of the bag by releasing said releasing means and when one strip engages and overlies the other strip with their longitudinal edges substantially aligned with one another, said front flap and a sufficient portion adjacent the lower longitudinal edge of said one of said pair of strips can be laterally rolled back away from the other of said pair of strips sufficiently to be directly gripped by human hands to laterally pull said one of said pair of strips out of attachment with said other of said pair of strips, whereby the initial lateral separation forces of both strips are intermediate the longitudinal edges of said strips substantially along the boundary of said engaging area and said remaining area so that peeling of either of said pair of strips from said front flap and front piece is prevented thereby avoiding delamination of either strip from the member of the bag to which it is adhesively attached.

8. The resealability improvement to a bag of claim 7 wherein:

(a) said attachment means comprises a strip of adhesive disposed along the bottom edge of said front flap to secure it to the front piece; and said releasing means comprises, (b) fracturing means disposed for fracturing and splitting said front flap adjacent the bottom edge of said pair of strips.

9. The resealability improvement to a bag of claim 8 wherein said fracturing means comprises:

a piece of cording disposed between said front flap and the front piece adjacent the top of said adhesive strip with the cord extending at least from between said front flap and the front piece sufficiently for gripping.

10. The resealability improvement to a bag of claim 7 wherein:

(a) said attachment means comprises a strip of chain-lock stitching disposed along the bottom edge of said front flap stitched through said front and rear flaps to secure said front flap to the front piece; and said releasing means comprises, (b) a pulls trip operably attached under said chain-lock stitching for unlocking and pulling said stitching out of said flaps.

11. A tamperproof resealable closure for a bag of flexible, frangible material including a bottom, opposed spaced sides, and opposed spaced front and rear pieces terminating at the top in front and rear edges respectively, said closure comprising:

(a) a flap-containing member of the flexible, frangible material having a front flap extending from a fold point over the front edge and down along the front piece and having a rear flap extending from said fold point over the rear edge and down along the rear piece;

(b) a strip of adhesive disposed along the bottom edge of said rear flap to secure it to the rear piece;

(c) releasably attachment means disposed along the bottom edge of said front flap for releasably securing the front flap to the front piece, said releasable attachment means comprising a strip of chain-lock stitching disposed along the bottom edge of said front flap stitched through said front and rear flaps to secure said front flap to the front piece;

(d) a pair of elongated strips of a hook and loop fastening system positioned to be disposed between said front flap and front piece above and adjacent to said releasably attachment means where one of said pair of strips is adhesively attached to said front flap and the other of said pair of strips is adhesively attached to the front piece, at least one of said pair of strips having an engaging area along an upper longitudinal edge portion which is sufficiently narrower than the engaging area of the other strip that the remaining area along a lower longitudinal edge of the one strip is lacking in the ability for that strip to form a releasable attachment to the adjacent area of the other strip, wherein said fold point of said flap-containing member provides a means of placing said strips in substantial alignment with one another along their longitudinal edges so that one strip overlies the other strip; and (e) releasing means, for releasing said releasable attachment means and said front flap in conjunction therewith close adjacent said lower longitudinal edges of said strips, whereby after initial opening of the bag by releasing said releasably attachment means and when one strip engages and overlies the other strip with their longitudinal edges substantially aligned with one another, said front flap and a sufficient portion adjacent the lower longitudinal edge of one of said pair of strips can be laterally rolled back away from the other of said pair of strips sufficiently to be directly gripped by human hands to laterally pull that strip out of attachment with the other strip, whereby the initial lateral separation forces of both strips are intermediate the longitudinal edges of said strips substantially along the boundary of said engaging area and said remaining area so that peeling of either of said pair of strips from said front flap and front piece is prevented thereby avoiding delamination of either strip from the member of the bag to which it is adhesively attached, and said releasing means comprises a pull strip operably attached under said chain-lock stitching for unlocking and pulling said stitching out of said flaps.

* * * * *